US012222190B2

(12) United States Patent
Wen

(10) Patent No.: US 12,222,190 B2
(45) Date of Patent: Feb. 11, 2025

(54) PORTABLE SCOPE MAGNIFICATION QUICK-ADJUSTMENT DEVICE

(71) Applicant: Nantong Yilong Machinery Manufacturing Co., Ltd., Nantong (CN)

(72) Inventor: Siyuan Wen, Tongzhou (CN)

(73) Assignee: Nantong Yilong Machinery Manufacturing Co., Ltd., Nantong (CN)

( * ) Notice: Subject to any disclaimer, the term of this patent is extended or adjusted under 35 U.S.C. 154(b) by 0 days.

(21) Appl. No.: 18/426,388

(22) Filed: Jan. 30, 2024

(65) Prior Publication Data

US 2024/0167788 A1 May 23, 2024

(51) Int. Cl.
*F41G 1/38* (2006.01)
*F41G 1/16* (2006.01)
*F41G 1/35* (2006.01)

(52) U.S. Cl.
CPC ..... *F41G 1/38* (2013.01); *F41G 1/16* (2013.01); *F41G 1/35* (2013.01)

(58) Field of Classification Search
CPC ..... F41G 1/16; F41G 1/24; F41G 1/35; F41G 1/38; F41G 11/003
USPC ..... 42/119
See application file for complete search history.

(56) References Cited

U.S. PATENT DOCUMENTS 4,952,041 A * 8/1990 Sandall ..... G02B 7/10 359/422
5,180,875 A * 1/1993 Berry, Jr. ..... F41G 1/38 359/422
5,388,005 A * 2/1995 Wilson ..... G02B 7/102 359/422
5,924,211 A * 7/1999 Wambold, Jr. ..... G02B 7/10 42/119
6,519,083 B2 * 2/2003 Heinrich ..... G02B 23/14 359/425
7,552,559 B2 * 6/2009 Day ..... G02B 23/145 42/122
8,458,944 B2 * 6/2013 Houde-Walter ..... F41C 23/16 42/72

(Continued)

FOREIGN PATENT DOCUMENTS

CN 217877337 U * 11/2022

*Primary Examiner* — Joshua E Freeman
*Assistant Examiner* — Benjamin S Gomberg
(74) *Attorney, Agent, or Firm* — Hemisphere Law, PLLC; Zhigang Ma

(57) ABSTRACT

A portable scope magnification quick-adjustment device comprises a main body and a motor seat, wherein the main body is mounted on a gun, the motor seat is mounted on a magnification rotating ring of a scope by means of a connecting piece, a circuit mainboard and a battery electrically connected to the circuit mainboard are arranged in the main body, a button is arranged on the circuit mainboard and located outside the main body, a motor is arranged in the motor seat and connected to the circuit mainboard by means of an electric conductor, a rotating shaft of the motor is connected to a drive mechanism, and the drive mechanism extends out and is in engaged connection with the magnification rotating ring. By combining electric driving and mechanical adjustment, the magnification can be adjusted more quickly to improve the shooting accuracy and speed.

13 Claims, 6 Drawing Sheets

(56) References Cited

U.S. PATENT DOCUMENTS

| | | | | |
|---|---|---|---|---|
| 9,310,165 | B2 * | 4/2016 | Bell | F41G 1/473 |
| 9,459,078 | B1 * | 10/2016 | Kincel | F41G 11/004 |
| 2005/0088729 | A1 * | 4/2005 | Edwards | F41G 1/38 359/359 |
| 2006/0096149 | A1 * | 5/2006 | Wooden | F41G 1/44 359/429 |
| 2009/0205239 | A1 * | 8/2009 | Smith, III | F41G 1/38 42/122 |
| 2009/0266892 | A1 * | 10/2009 | Windauer | F41G 3/06 235/404 |
| 2012/0255213 | A1 * | 10/2012 | Panos | F41G 1/35 42/146 |
| 2014/0157644 | A1 * | 6/2014 | Jiminez | F41G 11/003 42/114 |
| 2015/0241171 | A1 | 8/2015 | Theisinger | |
| 2016/0209176 | A1 * | 7/2016 | Zimmer | F41G 11/001 |
| 2017/0067721 | A1 * | 3/2017 | McKillips | F41G 11/003 |
| 2017/0102208 | A1 * | 4/2017 | Plumb | F41G 1/38 |
| 2019/0113307 | A1 * | 4/2019 | Lv | F41A 27/20 |
| 2019/0113707 | A1 | 4/2019 | Wang | |
| 2021/0377132 | A1 | 12/2021 | Somerfield | |
| 2023/0175814 | A1 * | 6/2023 | Meissen | F41C 23/16 362/11 |
| 2024/0160030 | A1 * | 5/2024 | Dohr | G02B 23/14 |
| 2024/0167788 | A1 * | 5/2024 | Wen | F41G 11/003 |

* cited by examiner

PORTABLE SCOPE MAGNIFICATION QUICK-ADJUSTMENT DEVICE

BACKGROUND OF THE INVENTION

Technical Field

The invention relates to the technical field of scope magnification auxiliary-adjustment devices, in particular to a portable scope magnification quick-adjustment device.

Description of Related Art

At present, the magnification of scopes is adjusted through a standard manual adjustment method. In order to select a desired optimal magnification of a scope, a shooter manually rotates a magnification rotating ring of the scope forward or reversely to obtain the optimal magnification. Due to the lack of a uniform adjustment standard for magnification rotating rings of scopes produced by different scope manufacturers, some of the magnification rotating rings are tight, while some are loose. Manual adjustment of the magnification rotating rings performed by shooters will compromise the shooting speed and accuracy. The greatest defect of manual adjustment is that, in order to obtain the optimal magnification, the shooter must adjust the magnification ring by a hand that should be holding the front holder of a gun, and holds the front end of the gun with this hand again after adjustment, so both the time efficiency and stability can still be improved to a great extent, and this is also the reason why different shooters have their own standards about the degree of tightness of the rotating rings. In view of this, a more portable and flexible operating device is needed on the market to overcome these defects, and better devices need to be developed to satisfy market requirements. In order to free one hand of shooters from frequent adjustment of the magnification rotating ring to capture a target more quickly and fulfill a stable shooting effect, it is necessary to develop an electrical-drive mechanical operating method.

BRIEF SUMMARY OF THE INVENTION

In view of the above mentioned defects in the prior art, the objective of the invention is to provide a portable scope magnification quick-adjustment device, which is more portable and lighter and can realize quicker and more stable adjustment.

To fulfill the above objective, the invention adopts the following technical solution:

A portable scope magnification quick-adjustment device includes a main body, a connecting piece, a motor seat, a circuit mainboard, a battery, a button, a motor, and a drive mechanism. The main body is mounted on a gun. The motor seat is mounted on a scope by means of the connecting piece. The circuit mainboard and the battery are both arranged in the main body, where the battery is electrically connected to the circuit mainboard. The button is arranged on the circuit mainboard and extends outside of the main body for realizing work control. The motor is arranged in the motor seat and electrically connected to the circuit mainboard by means of an electric conductor, where a rotating shaft of the motor extends outside of the motor seat. The drive mechanism is located outside of the motor seat and connected to the rotating shaft, where the drive mechanism is in engaged connection with the magnification rotating ring.

Preferably, the drive mechanism is a gear set or is formed by a gear and a synchronous belt.

Preferably, the connecting piece is provided with two sockets to receive the scope and the motor seat respectively, wherein the two sockets are arranged at two ends of the connecting piece respectively, and the connecting piece further comprises two pressing blocks, wherein the two pressing blocks are connected to the two sockets through fasteners respectively, to lock the scope and the motor seat to the connecting piece respectively, so as to mount the motor seat on the scope through the connecting piece.

Preferably, the portable scope magnification quick-adjustment device further includes a gun light or a laser light for assisting in aiming and shooting, where the gun light or the laser light is arranged at a front end of the main body and electrically connected to the circuit mainboard.

Preferably, a slot is formed in a bottom of the main body to receive a front sight holder of the gun. The portable scope magnification quick-adjustment device further includes lock blocks that are arranged on a side of the main body and mounted on the main body through fasteners; wherein a free end of the fastener on the lock block extends outside of the lock block and is connected with the front sight holder located in the slot; wherein the main body is mounted on the gun through the front sight holder by tightening the fasteners; the lock blocks and the front sight holder of the gun come closer to each other by tightening the fasteners; left and right adjustment of a lighting center of the gun light or the laser light is achieved by adjusting the degree of tightness of the fasteners on the lock blocks.

Preferably, the battery is a rechargeable battery, the circuit mainboard is provided with a charging port, and the charging port is located outside of the main body and sealed by a rubber plug.

Preferably, anti-slip wavy lines are arranged on a surface of the main body.

Preferably, the button is a press switch or a push switch.

Preferably, the portable scope magnification quick-adjustment device further comprises a cover arranged on the motor seat, wherein the cover is configured to cover the drive mechanism and the rotating shaft of the motor; wherein the cover is provided with a through hole to expose a portion of the drive mechanism, so that the drive mechanism is able to be in engaged connection with the magnification rotating ring.

By adopting the above solution, an electric driving function can be realized based on original mechanical pushing of the magnification rotating ring, electric power is output to drive the motor to rotate, and the motor works together with the drive mechanism to realize high-accuracy magnification adjustment of the scope, thus avoiding inaccuracy caused by manual adjustment and errors caused by different degrees of tightness of the magnification rotating ring in actual operation. Therefore, by combining electric driving and mechanical adjustment, the magnification can be adjusted more quickly to improve the shooting accuracy and speed.

DETAILED DESCRIPTION OF THE INVENTION

Figure 1:
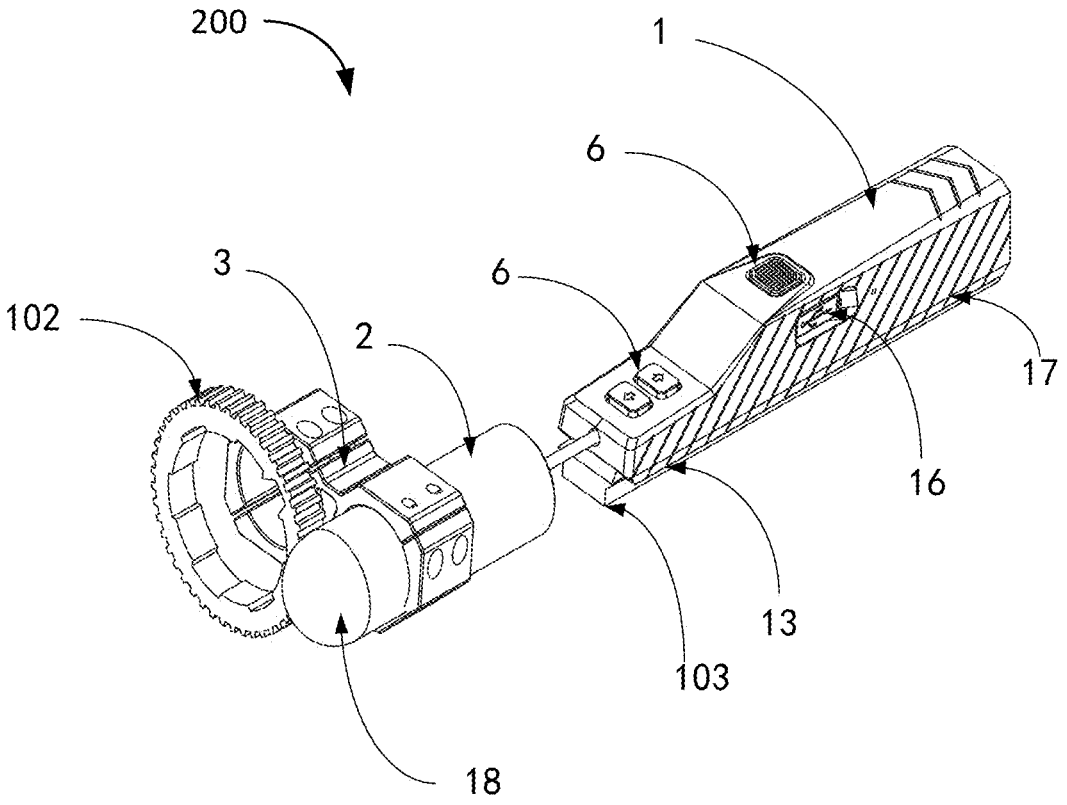
FIG. 1 is a schematic structural diagram of one embodiment of the invention.

To gain a better understanding of the objectives, technical solutions and advantages of the invention, the invention will be described in further detailed below in conjunction with accompanying drawings and embodiments. It should be understood that the specific embodiments in the following description are merely used for explaining the invention and are not intended to limit the invention.

In the description of the invention, it should be understood that terms such as "center", "lengthwise", "crosswise", "length", "width", "thickness", "upper", "lower", "front", "back", "left", "right", "vertical", "horizontal", "top", "bottom", "inner", "outer", "clockwise" and "anticlockwise" are used for indicating directional or positional relations based on the accompanying drawings merely for the purpose of facilitating and simplifying the description of the invention, do not imply or indicate that devices or elements referred to must be in a specific direction or be configured and operated in a specific direction, and thus should not be construed as limitations of the invention. In addition, terms such as "first" and "second" are merely for the purpose of description, and should not be construed as indicating or implying relative importance or implicitly indicating the number of technical features referred to. Therefore, a feature defined by "first" or "second" may explicitly or implicitly indicate the inclusion of one or more said features. In the description of the invention, "multiple" means two or more, unless otherwise expressly defined.

In the description of the invention, it should be noted that, unless otherwise expressly stated and defined, terms such as "mount", "link" and "connect" should be broadly understood. For example, "connect" may refer to fixed connection, detachable connection or integrated connection; or, mechanical connection or electrical connection; or, direct connection, indirect connection through an intermediate medium, internal connection or interaction of two elements. Those ordinarily skilled in the art can appreciate the specific meanings of these terms in the invention as the case may be.

As shown in FIG. 1-FIG. 6, this embodiment provides a portable scope magnification quick-adjustment device 200 that includes a main body 1 and a motor seat 2, wherein the main body 1 is mounted on a gun 100, the motor seat 2 is mounted on a scope 101 by means of a connecting piece 3, a circuit mainboard 4 and a battery 5 electrically connected to the circuit mainboard 4 are arranged in the main body 1, buttons 6 are arranged on the circuit mainboard 4 and extend outside of the main body 1, a motor 7 is arranged in the motor seat 2 and electrically connected to the circuit mainboard 4 by means of an electric conductor 8, a rotating shaft 71 of the motor 7 extends outside of the motor seat 2 and is connected to a drive mechanism 9 that is located outside of the motor seat 2, and the drive mechanism 9 is in engaged connection with a magnification rotating ring 102 of the scope 101.

In this embodiment, the circuit mainboard 4 is arranged in the main body 1 and the drive mechanism 9 driven by the motor 7 to adjust the magnification rotating ring 102 is assembled on the scope 101. When the portable scope magnification quick-adjustment device 200 is assembled, the motor seat 2 is fixedly mounted on the scope 101 by means of the connecting piece 3, and the drive mechanism 9 of the motor 7 is in engaged connection with the magnification rotating ring 102, such that the magnification rotating ring 102 can be driven by the drive mechanism 9 to rotate. In this way, an electric driving function can be realized based on original mechanical pushing of the magnification rotating ring 102. Electric power is output to drive the motor 7 to rotate, and the motor 7 works together with the drive mechanism 9 to realize high-accuracy magnification adjustment of the scope 101, thus avoiding inaccuracy caused by manual adjustment and errors caused by different degrees of tightness of the magnification rotating ring 102 in actual operation. Therefore, by combining electric driving and mechanical adjustment, the magnification can be adjusted more quickly to improve the shooting accuracy and speed.

Figure 5:
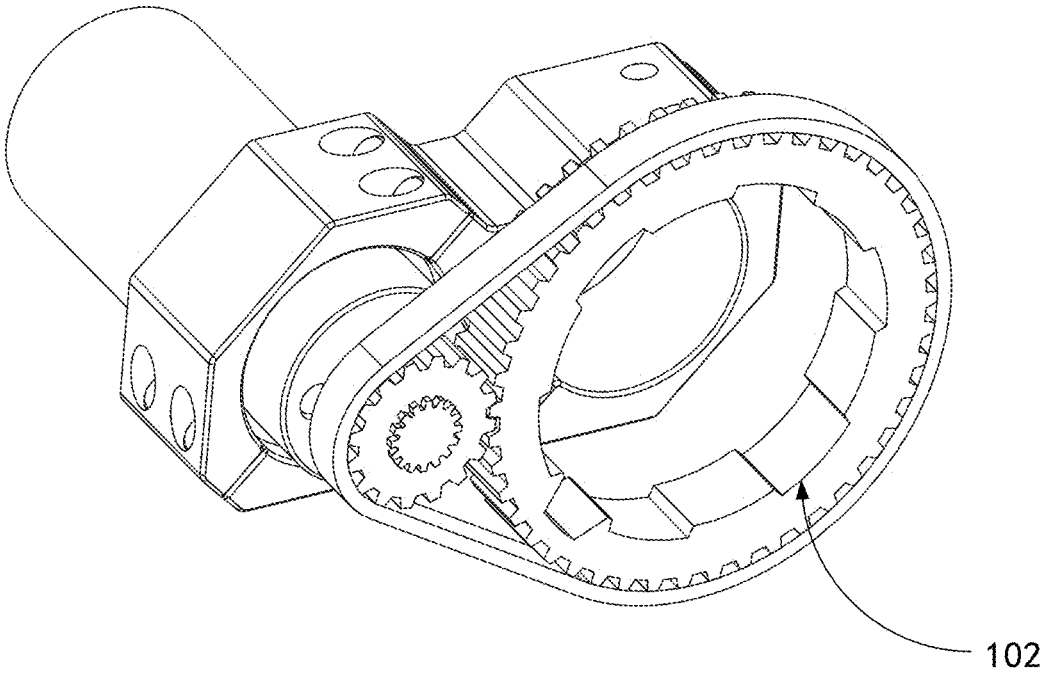
FIG. 5 is a schematic structural diagram of a drive mechanism formed by a gear and a synchronous belt according to one embodiment of the invention.
Figure 6:
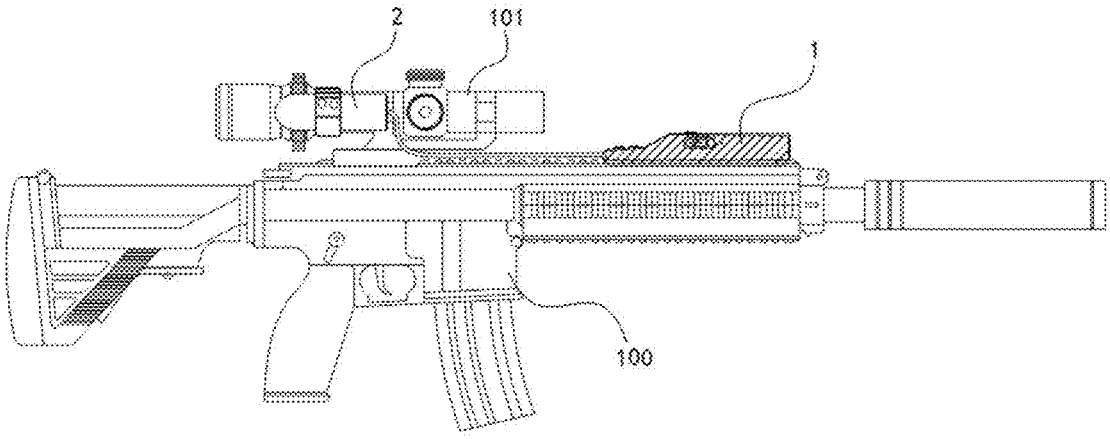
FIG. 6 is a schematic structural diagram of a portable scope magnification quick-adjustment device mounted on a gun according to one embodiment of the invention.

Further, regarding the specific structure of the drive mechanism 9 in this embodiment, the drive mechanism 9 may be a gear set or be formed by a gear and a synchronous belt (as shown in FIG. 5). In a case where the gear set is used as the drive mechanism, at least one gear is needed for transmission, and engaging teeth of the gear should match engaging teeth of the magnification rotating ring 102. In a case where the drive mechanism is formed by the gear and the synchronous belt, engaging teeth of the synchronous belt, the gear and the magnification rotating ring should match mutually, such that the magnification of the scope 101 can be adjusted by means of forward or reverse rotation of the motor 7. The motor is generally a gear motor, which can operate more stably, and each engaging tooth is used as a reference for magnification adjustment. To avoid a strong sense of vibration and loud noise during operation of the motor 7, a colloid with soft properties, such as silicone, may be arranged at a front end of the motor 7 to reduce vibrations and insulate noise.

Figure 2:
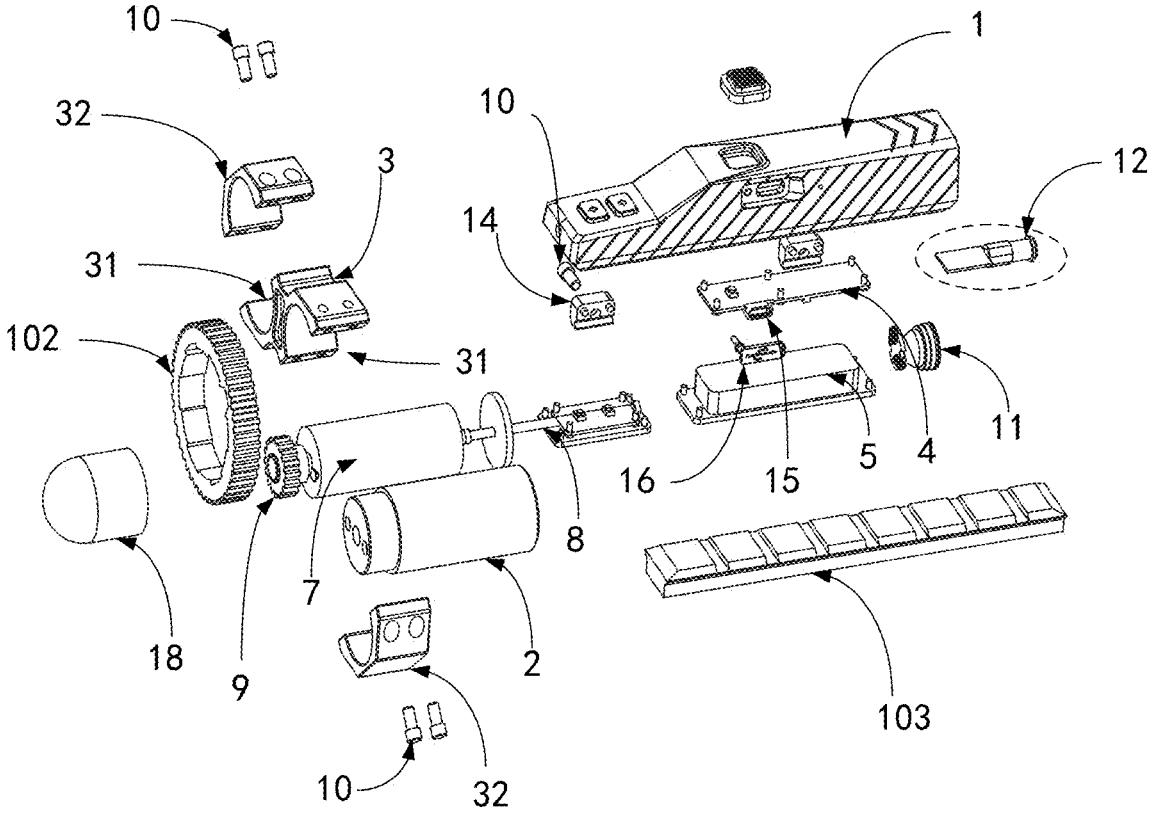
FIG. 2 is an exploded structural view of one embodiment of the invention.

Further, regarding the installation of the connecting piece 3 between the motor seat 2 and the scope 101 in this embodiment, as shown in FIG. 2, the connecting piece 3 is provided with two sockets 31 to receive the scope 101 and the motor seat 2 respectively. The two sockets 31 are arranged at two ends of the connecting piece 3 respectively, where the size of one of the sockets 31 corresponds to the lens size of the scope 101, and the size of the other one of the sockets 31 corresponds to the size of the motor seat 2. The connecting piece 3 further includes two pressing blocks 32, where the two pressing blocks 32 are connected to the two sockets 31 through fasteners 10 (bolts, generally) respectively. In this way, the motor seat 2 is mounted in one socket 31 by one step and locked by the corresponding fastener 10, then the scope 101 is mounted in the other socket 31, and finally, the corresponding fastener 10 is tightened. Thus, the scope 101 and the motor seat 2 are locked to the connecting piece 3 respectively, so as to mount the motor seat 2 on the scope 101 through the connecting piece 3.

Figure 3:
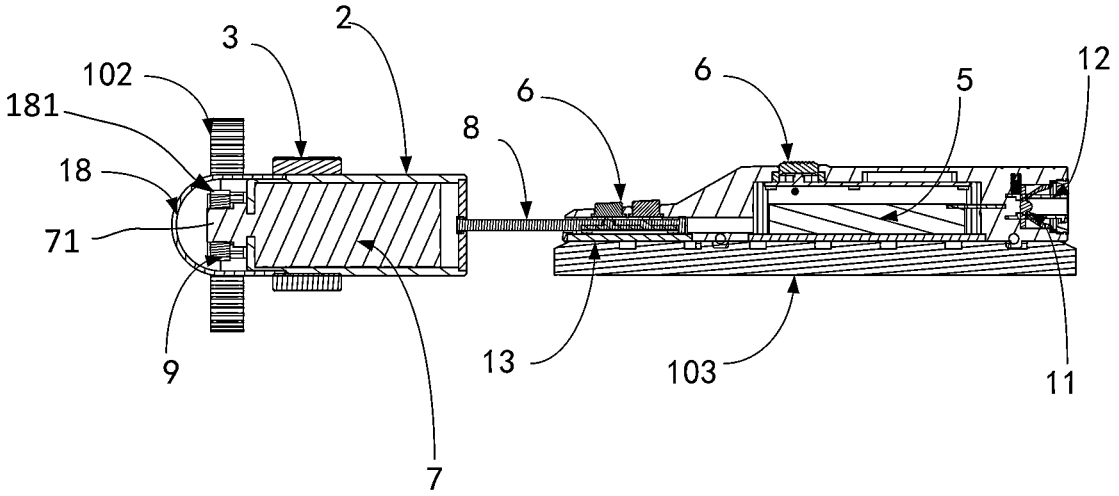
FIG. 3 is a sectional structural view of one embodiment of the invention.

Further, to diversified the functions, as shown in FIG. 2 and FIG. 3, the portable scope magnification quick-adjustment device 200 further includes a gun light 11 or a laser light 12 that is arranged at the front end of the main body 1 in this embodiment, and the gun light 11 and the laser light 12 are electrically connected to the circuit mainboard 4. In this way, during aiming and shooting, the gun light 11 or the laser light 12 can be turned on to assist in aiming and shooting.

Further, regarding the installation of the main body 1, a slot 13 is formed in the bottom of the main body 1 to receive a front sight holder 103 of the gun 100. The portable scope magnification quick-adjustment device 200 further includes lock blocks 14 that are arranged on a side of the main body 1 and mounted on the main body 1 through fasteners 10. A free end of the fastener 10 on the lock block 14 extends outside of the lock block 14 and connected with the front sight holder 103 located in the slot 13. In this way, by tightening the fasteners 10, the main body 1 can be mounted on the gun 100 through the front sight holder 103, and the lock blocks 14 and the front sight holder 103 of the gun 100 come closer to each other. When installed, the main body 1 is assembled on the front light holder 103 of the gun 100 by means of the slot 13; after the main body 1 is installed in position, the fasteners 10 on the lock blocks 14 are tightened; after the fasteners 10 on the lock blocks 14 are tightened, installation of the main body 1 on the gun 100 is completed; and left and right adjustment of the lighting center of the gun light 11 or the laser light 12 can be achieved by adjusting the degree of tightness of the fasteners 10 on the lock blocks 14, thus, a front sight can be adjusted.

Further, in this embodiment, power to the circuit mainboard 4 and the motor 7 is supplied by the battery 5, and the battery 5 can be used repeatedly. In this embodiment, the battery 5 is a rechargeable battery, the circuit mainboard 4 is provided with a charging port 15, and the charging port 15 is located outside of the main body 1 and sealed by a rubber plug 16 to be protected.

Further, in this embodiment, to fulfill an anti-slip effect of the main body 1 when the main body 1 is held, as shown in FIG. 1, anti-slip wavy lines 17 are arranged on the surface of the main body 1.

Figure 4:
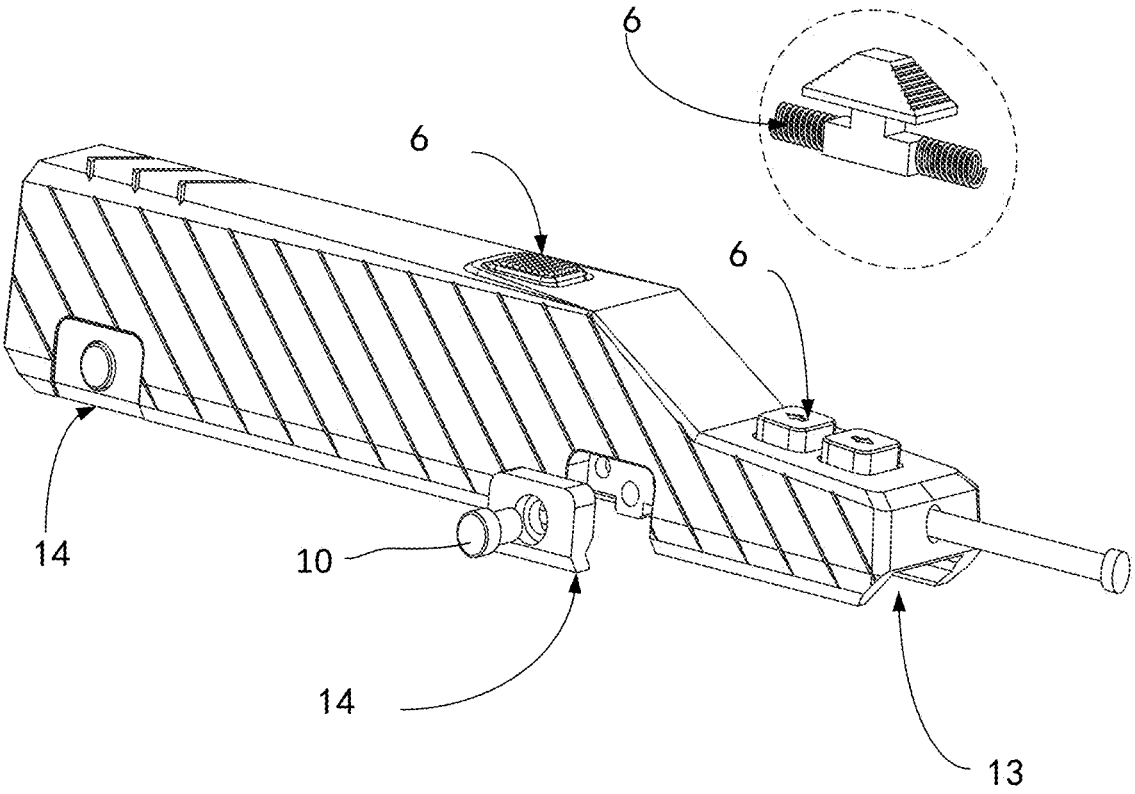
FIG. 4 is a schematic structural diagram of a main body in the presence of multiple buttons according to one embodiment of the invention.

Further, in this embodiment, key personnel can press the buttons 6 to realize work control, and as shown in FIG. 4, the buttons 6 may be press switches or push switches.

Further, in this embodiment, to prevent sundries from falling onto the rotating shaft 71 of the motor 7, as shown in FIG. 2 and FIG. 3, a cover 18 for covering the drive mechanism 9 and the rotating shaft 71 of the motor 7 is arranged on the motor seat 2, and a through hole 181 is formed in the cover 18 corresponding to the drive mechanism 9, so that the drive mechanism 9 can be exposed through the through hole 181 and in engaged connection with the magnification rotating ring 102.

The above embodiments are merely preferred ones of the invention and should not be construed as limitations of the invention. All equivalent structures or equivalent flow transformations made according to the contents of the specification and drawings of the invention, or direct or indirect applications to other related technical fields should also fall within the patent protection scope of the invention.

What is claimed is:

1. A portable scope magnification quick-adjustment device, comprising:

a main body mounted on a gun;

a connecting piece;

a motor seat mounted on a scope by means of the connecting piece;

a circuit mainboard and a battery both arranged in the main body, wherein the battery is electrically connected to the circuit mainboard;

a button arranged on the circuit mainboard and extending outside of the main body;

a motor arranged in the motor seat and electrically connected to the circuit mainboard by means of an electric conductor, wherein a rotating shaft of the motor extends outside of the motor seat;

a drive mechanism located outside of the motor seat and connected to the rotating shaft, wherein the drive mechanism is in engaged connection with a magnification rotating ring, wherein the connecting piece is provided with two sockets to receive the scope and the motor seat respectively, wherein the two sockets are arranged at two ends of the connecting piece respectively; and the connecting piece further comprises two pressing blocks, wherein the two pressing blocks are connected to the two sockets through fasteners respectively, to lock the scope and the motor seat to the connecting piece respectively, so as to mount the motor seat on the scope through the connecting piece.

2. The portable scope magnification quick-adjustment device according to claim 1, wherein the drive mechanism is a gear set or is formed by a gear and a synchronous belt.

3. The portable scope magnification quick-adjustment device according to claim 1, further comprising a gun light or a laser light for assisting in aiming and shooting, wherein the gun light or the laser light is arranged at a front end of the main body and electrically connected to the circuit mainboard.

4. The portable scope magnification quick-adjustment device according to claim 3, wherein a slot is formed in a bottom of the main body to receive a front sight holder of the gun;

the portable scope magnification quick-adjustment device further comprises lock blocks that are arranged on a side of the main body and mounted on the main body through fasteners; wherein a free end of each of the fasteners on the lock blocks extends outside of the lock blocks and is connected with the front sight holder located in the slot; wherein the main body is mounted on the gun through the front sight holder by tightening the fasteners; the lock blocks and the front sight holder of the gun come closer to each other by tightening the fasteners; left and right adjustment of a lighting center of the gun light or the laser light is achieved by adjusting the degree of tightness of the fasteners on the lock blocks.

5. The portable scope magnification quick-adjustment device according to claim 1, wherein the battery is a rechargeable battery, the circuit mainboard is provided with a charging port, and the charging port is located outside of the main body and sealed by a rubber plug.

6. The portable scope magnification quick-adjustment device according to claim 1, wherein anti-slip wavy lines are arranged on a surface of the main body.

7. The portable scope magnification quick-adjustment device according to claim 1, wherein the button is a press switch or a push switch.

8. The portable scope magnification quick-adjustment device according to claim 1, further comprising a cover arranged on the motor seat, wherein the cover is configured to cover the drive mechanism and the rotating shaft of the motor; wherein the cover is provided with a through hole to expose a portion of the drive mechanism so that the drive mechanism is able to be in engaged connection with the magnification rotating ring.

9. A portable scope magnification quick-adjustment device, comprising:

a main body mounted on a gun;

a connecting piece;

a motor seat mounted on a scope by means of the connecting piece;

a circuit mainboard arranged in the main body;

a motor arranged in the motor seat and electrically connected to the circuit mainboard; wherein a rotating shaft of the motor extends outside of the motor seat;

a drive mechanism located outside of the motor seat and connected to the rotating shaft, wherein the drive mechanism is in engaged connection with the magnification rotating ring; and a cover arranged on the motor seat, wherein the cover is configured to cover the drive mechanism and the rotating shaft of the motor; wherein the cover is provided with a through hole to expose the drive mechanism, so that the drive mechanism is able to be in engaged connection with a magnification rotating ring;

wherein the connecting piece is provided with two sockets to receive the scope and the motor seat respectively, wherein the two sockets are arranged at two ends of the connecting piece respectively; and the connecting piece further comprises two pressing blocks, wherein the two pressing blocks are connected to the two sockets through fasteners respectively, to lock the scope and the motor seat to the connecting piece respectively, so as to mount the motor seat on the scope through the connecting piece.

10. The portable scope magnification quick-adjustment device according to claim 9, further comprising a button arranged on the circuit mainboard and extending outside of the main body, wherein the button is a press switch or a push switch.

11. The portable scope magnification quick-adjustment device according to claim 9, wherein the drive mechanism is a gear set or is formed by a gear and a synchronous belt.

12. The portable scope magnification quick-adjustment device according to claim 9, further comprising a gun light or a laser light for assisting in aiming and shooting, wherein the gun light or the laser light is arranged at a front end of the main body and electrically connected to the circuit mainboard.

13. The portable scope magnification quick-adjustment device according to claim 12, wherein a slot is formed in a bottom of the main body to receive a front sight holder of the gun;

the portable scope magnification quick-adjustment device further comprises lock blocks that are arranged on a side of the main body and mounted on the main body through fasteners; wherein a free end of each of the fasteners on the lock blocks extends outside of the lock blocks and is connected with the front sight holder located in the slot; wherein the main body is mounted on the gun through the front sight holder by tightening the fasteners; the lock blocks and the front sight holder of the gun come closer to each other by tightening the fasteners; left and right adjustment of a lighting center of the gun light or the laser light is achieved by adjusting the degree of tightness of the fasteners on the lock blocks.

* * * * *